US005930919A

United States Patent [19]

Mathias

[11] Patent Number: 5,930,919

[45] Date of Patent: Aug. 3, 1999

[54] SHOE SOLE

[76] Inventor: Timothy Scott Mathias, 1439 Idaho Ave. E., St. Paul, Minn. 55106

[21] Appl. No.: 09/153,010

[22] Filed: Sep. 14, 1998

[51] Int. Cl.[6] ..... A43B 13/20

[52] U.S. Cl. ..... 36/29; 36/30 R

[58] Field of Search ..... 36/29, 35 B, 153, 36/28, 3 B, 30 R

[56] References Cited

U.S. PATENT DOCUMENTS 1,145,533 7/1915 Wetmore .
2,237,190 4/1941 McLeod .
2,968,105 1/1961 Rizzo .
4,779,359 10/1988 Famolare, Jr. .
5,295,314 3/1994 Moundjian .
5,794,361 8/1998 Sadler .

*Primary Examiner*—Ted Kavanaugh
*Attorney, Agent, or Firm*—Thomas B. Tate

[57] ABSTRACT

A shoe sole construction which provides a complete separation of upper and lower soles with a cushion of air filling in the space between the upper and lower soles. The sole has five layers, namely, a bottom sole, a chamber rim, a chamber cover, an insole, and an insole cover.

2 Claims, 2 Drawing Sheets

SHOE SOLE

BACKGROUND OF THE INVENTION

Various attempts have been made to provide air cushioning in shoe soles for greater comfort. The Nike Air with pump has an air pocket in the heel. Some hockey skates have puffing around the insole. U.S. Patents and which describe shoe soles that are inflatable or have air cushioning in parts of the sole include U.S. Pat. No. 4,397,104 to Doak, U.S. Pat. NO. 5,025,575 to Lakic, U.S. Pat. No. 5,199,191 to Moumdjian, U.S. Pat. No. 5,503,786 to Yang, and U.S. Pat. No. 5,577,334 to Park. However, none of the known prior art shows a complete air separation of upper and lower soles as does the present invention.

SUMMARY OF THE INVENTION

The invention is a shoe sole which has the upper and lower soles completely separated by air and which has the capability of varying the amount of air pressure within the sole.

An advantage of the invention is that the complete separation allows for air support for all parts of the foot.

Another advantage of the invention is that the air pressure can be varied by pumping in different amounts of air in order to adjust for comfort. For example, atmospheric pressure for standing, medium pressure for walking, maximum pressure for running or heavy lifting, thus lessening impact, or more air for heavier people and less for lighter people. The air circulates through holes and cutouts in various layers of the sole in response to varying foot pressure.

Another advantage is that the sole can be inflated using common equipment such as a bicycle pump or a ball valve type of pump. No specialized equipment is needed Another advantage is that the air in the sole provides insulation by reducing the transfer of heat or cold.

Another advantage is that the amount of air in certain parts of the sole can varied for special needs, such as orthopedic shoes, or shoes custom made for unusual sizes or shapes of feet.

DESCRIPTIONS OF THE DRAWINGS

DESCRIPTION OF THE PREFERRED EMBODIMENT OF THE INVENTION

Figure 1:
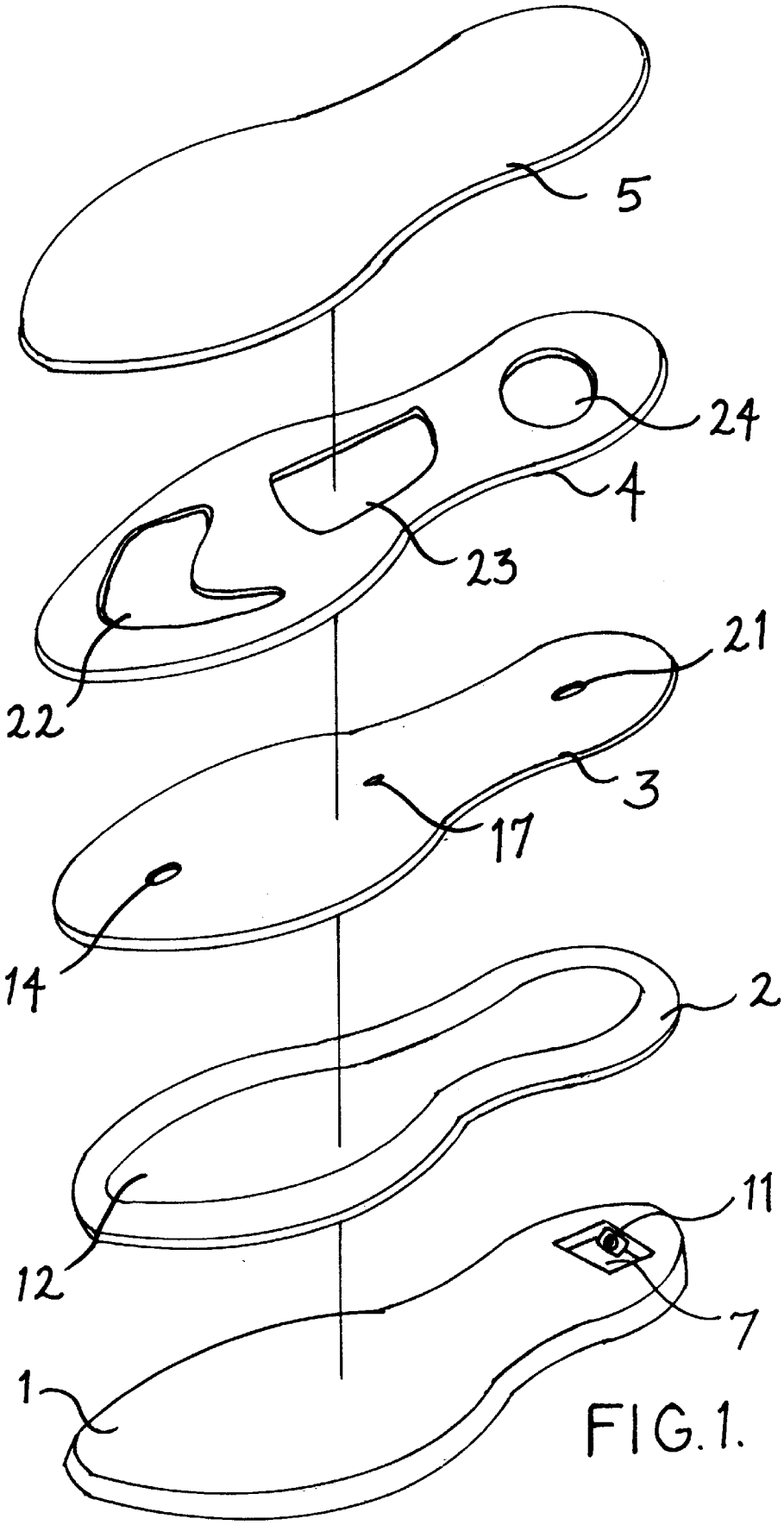
FIG. 1 is an exploded view showing the five layers.
Figure 2:
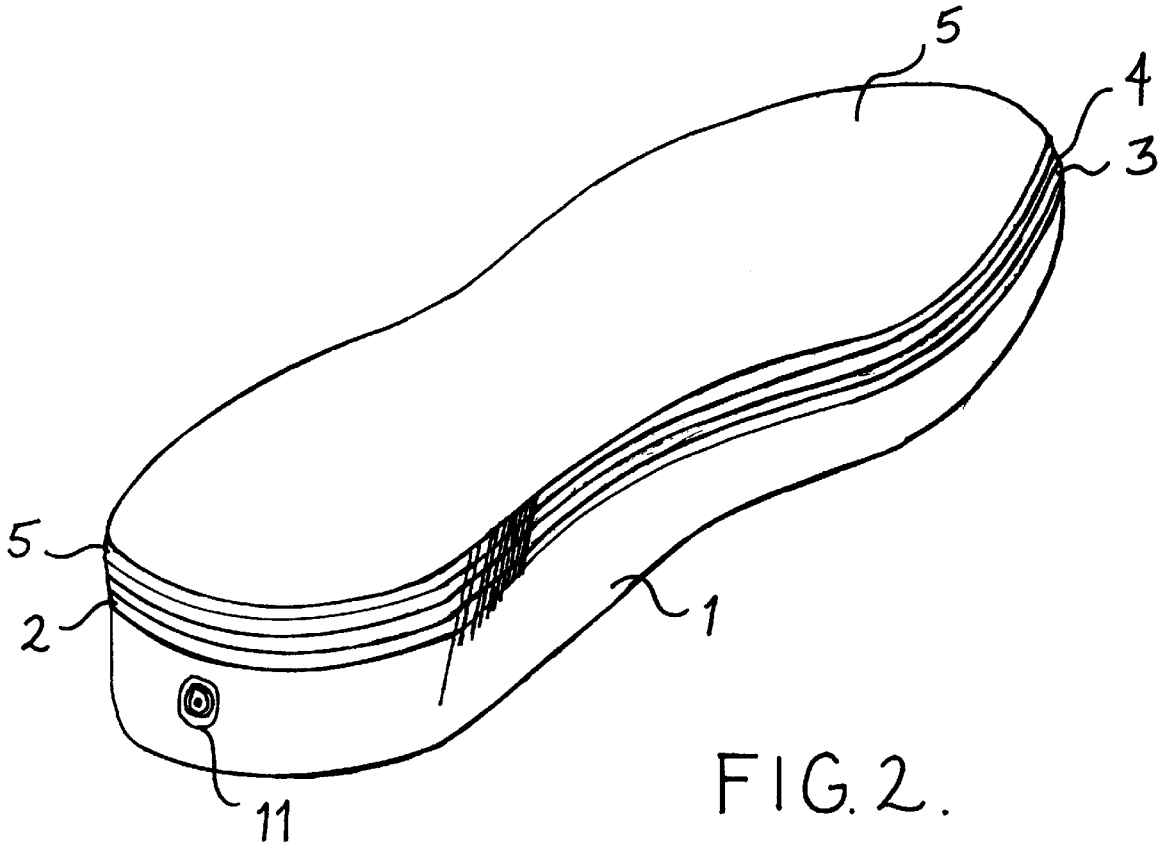
FIG. 2 is a top perspective view.

The shoe sole has complete separation of the upper and lower soles by means of air. There are five layers in the sole, from bottom to top: a bottom sole 1, a chamber rim 2, a chamber over 3, an insole 4, and an insole cover 5. The bottom sole 1, chamber rim 2, and chamber cover 3 collectively comprise the lower sole, and the insole 4 and insole cover 5 collectively comprise the upper sole.

The bottom sole 1 is the thickest layer. A pocket 7, which on be either square or round, is formed into the heel area of the bottom sole 1. The stem of a valve 11 is recessed into the vertical edge of the heel area of bottom layer 1. The valve 11 projects into the pocket 7. The valve 11 can be a needle-stem valve as shown, or alternatively can be a Schrader valve of the type used on bicycle tires. Air can be pumped into the pocket 7 through valve 11 using a conventional bicycle pump.

The chamber rim 2 has a large cutout area 12 extending throughout the central part of the ball, arch, and heel sections of the sole. The chamber cover 3 has three holes formed into it, a ball hole 14, an arch hole 17, and a heel hole 21. The arch holes 17 is smaller than the other two holes. As a result, when the chamber formed by the chamber rim 2 and chamber cover 3 is pressurized by pumping in air, the press will remain more constant because there is not as much foot pressure at the arch as at the ball and heel.

The insole 4 has formed into it three cutouts 22, 23, and 24 in the ball, arch and heel, respectively. Air presses upward through ball cutout 22, arch cutout 23, and heel cutout 24. The insole cover 5, which has no openings, hermetically seals the air inside the sole.

This type of sole can be manufactured by either lamination or injection molding.

This type of sole construction is suitable for any type of shoe, including but not limited to, work boots, snow boots, running shoes, walking shoes, sandals, orthopedic shoes, and casual shoes.

I claim:

1. A shoe sole construction comprising five layers aligned from bottom to top as follows:

a bottom sole having a pocket formed into the heel area and a valve stem recessed into the vertical edge of the heel area and projecting into said pocket so as to allow said pocket to be inflatable;

a chamber rim having a large cutout extending throughout the central part of the ball, arch, and heel sections of the sole;

a chamber cover having holes formed in the ball, arch, and heel sections, the arch hole being smaller than the ball and heel holes;

an insole having cutouts in the ball, arch, and heel sections;

an insole cover which has not openings and which creates a seal for the sole.

2. The construction of claim 1 wherein said bottom sole, chamber rim, and chamber cover comprises the lower sole, and said insole and insole cover comprise the upper sole and wherein said upper and lower soles are completely separated by a cushion of air which circulates through said holes and cutouts in said layers.

* * * * *

UNITED STATES PATENT AND TRADEMARK OFFICE

CERTIFICATE OF CORRECTION

PATENT NO. : 5,930,919

DATED : Aug. 3,1999

INVENTOR(S) : Timothy Scott Mathias

It is certified that error appears in the above-identified patent and that said Letters Patent is hereby corrected as shown below:

Col 1,line 7- "and" should be deleted

Col 1,line 53- "over" should read "cover"

Col. 2,line 16- "press" should read "pressure"

Claim 1,line 15 (col. 2,line 47) - "not" should read "no"

Claim 2,line 2 (col. 2,line 50)- "comprises" should read "comprise"

Signed and Sealed this

Thirtieth Day of November, 1999

*Attest:*

*Attesting Officer*

Q. TODD DICKINSON

*Acting Commissioner of Patents and Trademarks*